United States Patent [19]

Davis

[11] 4,160,297

[45] Jul. 10, 1979

[54] PULP WASHER

[75] Inventor: Steven S. Davis, Bountiful, Utah

[73] Assignee: Envirotech Corporation, Menlo Park, Calif.

[21] Appl. No.: 853,068

[22] Filed: Nov. 21, 1977

[51] Int. Cl.[2] ..... D06B 3/02

[52] U.S. Cl. ..... 8/156; 68/44; 68/158; 68/181 R; 68/208; 68/DIG. 5

[58] Field of Search ..... 8/156; 68/DIG. 5, 27, 68/44, 158, 181 R, 208, 20, 19.1

[56] References Cited

U.S. PATENT DOCUMENTS

| | | | |
|---|---|---|---|
| 899,440 | 9/1908 | Shuman et al. | 68/44 X |
| 2,745,712 | 5/1956 | Burling et al. | 68/27 X |
| 3,834,869 | 9/1974 | Ancelle et al. | 68/44 X |
| 3,857,261 | 12/1974 | Wilcox | 68/27 X |

FOREIGN PATENT DOCUMENTS

| | | | |
|---|---|---|---|
| 76401 | 11/1954 | Netherlands | 68/27 |

*Primary Examiner*—Philip R. Coe

*Attorney, Agent, or Firm*—Hal J. Bohner; Robert E. Krebs

[57] ABSTRACT

A machine and process for washing paper stock pulp and similar free-filtering materials includes two or more horizontally-disposed wash drums mounted each in a tank. Two endless filter belts are trained to pass under each of said wash drums and through liquid contained in each of the tanks. A mat of pulp is formed between the two endless filter belts and carried under each of the wash drums for washing therein. Wash liquor passes through the pulp mat as it travels under each of the drums thereby washing the pulp mat, and the liquor passes between the drums by gravity flow. After the pulp has been washed it is removed from between the two belts.

11 Claims, 3 Drawing Figures

PULP WASHER

BACKGROUND OF THE INVENTION

1. Field of the Invention

The present invention relates to machines for washing paper stock pulp and other free-filtering materials.

2. State of the Art

According to various processes well-known in the paper making industry, paper stock pulp is formed by digesting wood chips in the presence of various chemicals in a heated pressure vessel. After discharge from the pressure vessel, the paper stock pulp must be washed and filtered to separate the wood fibers from the digestion chemicals.

One system for washing paper stock pulp is taught in U.S. Pat. No. 2,355,243. According to that patent, paper stock is diluted with water after digestion and then is picked up by a large-diameter rotating cylinder whose surface is formed of a wire mesh screen. A couch roll is positioned to press downward onto the surface of the screen-covered cylinder to express liquid from the stock and thus to form a residual blanket or mat of dewatered fibers. The system described in the patent further includes an agitation device wherein once-dewatered fibers are repulped by mixing with water. Still further, the system taught in the patent includes additional agitation devices, screen-covered cylinders, and couch rolls to wash the pulp in stages.

According to other processes well-known in the paper-making industry, materials such as waste paper and groundwood, although not digested with chemicals, must nevertheless be washed. Conventional systems for such washing are also known.

OBJECTS OF THE INVENTION

The primary object of the present invention is to provide an improved machine to wash paper stock pulp and other free-filtering materials. As will be readily understood in view of the following description, the term free-filtering encompasses materials which, when covering a filtering surface, allow liquid to pass readily there through when a slight hydraulic head is exerted. The term pulp is used herein as a synonym for free filtering materials.

A more specific object of the present invention is to provide an improved machine for washing pulp, which machine is of the type which operates without interstage pumps.

Yet another object of the present invention is to provide an improved machine for washing pulp which operates without re-pulping of the pulp stock.

Still another object of the present invention is to provide a machine for washing pulp wherein frothing of the pulp is substantially minimized.

BRIEF DESCRIPTION OF THE DRAWINGS

The above and other objects of the present invention may be readily ascertained by consideration of the following detailed description and appended drawings, which are offered by way of illustration only and not in limitation of the invention, the scope of which is defined by the appended claims and equivalents.

In the drawings.

DETAILED DESCRIPTION OF THE INVENTION

Figure 1:
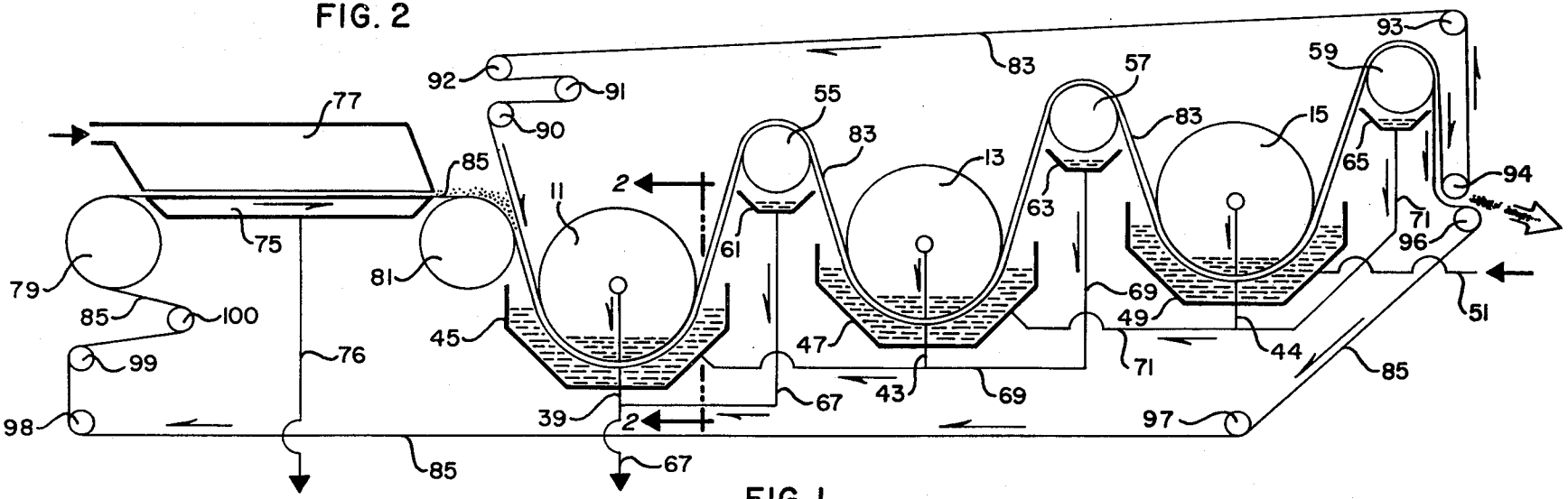
FIG. 1 is a side elevation of a machine according to the present invention shown schematically.

As shown in FIG. 1, a machine according to this invention generally includes horizontally-disposed wash drums 11, 13, and 15 which are mounted in spaced-apart, side-by-side relationship. The wash drums are illustrated as being cylinders of equal diameter but, in certain instances, it may be desirable for the wash drums to have progressively larger or smaller diameters. The wash drums are mounted in vertically stepped relationship to one another so that the central axis of the first drum 11 is lower than the central axis of the second drum 13 which, in turn, is lower than the axis of the third drum 15. The three illustrated drums are essentially the same in construction and operation and, for that reason, only one wash drum 11 will now be described in detail.

Figure 2:
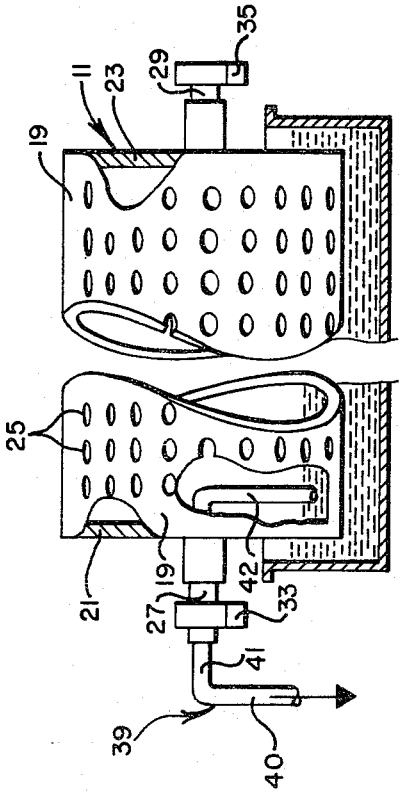
FIG. 2 is a view taken along line 2—2 in FIG. 1 for viewing in the direction of the arrows which schematically illustrates one detail of the machine of FIG. 1 partially cut away.

With reference now to FIGS. 1 and 2, the wash drum 11 includes a cylindrical sidewall 19 and end closure walls 21 and 23. The cylindrical sidewall is reticulated, say by small spaced-apart apertures 25 to permit liquid to flow freely into the drum. Workers skilled in this art will readily recognize that the sidewalls of the drums, instead of being reticulated, could be comprised of a wedgewire grid or other conventional support means which permit liquid flow communication with the interior of the drum. The end closure walls 21 and 23 are nonforaminate in this embodiment. Axle members 27 and 29 are fixed to the end closure walls 21 and 23, respectively, and are supported for rotation outboard of the drum by stationary pillow blocks 33 and 35, respectively, or other journal means.

According to the embodiment in FIG. 2, a syphon tube 39 is stationarily mounted to extend into the wash drum 11 to draw liquid from its interior. The illustrated syphon tube 39, which is also called a barometric leg in this art, has an inverted U-shaped configuration and includes a first leg 40 which extends downward outboard of the drum, a horizontal section 41 which extends horizontally into the drum through the axle member 27, and a second leg 42 which extends downward inside the drum and terminates adjacent the cylindrical sidewall 19.

With respect to the complete machine in FIG. 1, syphon tubes 39, 43, and 44 are mounted in communication with the interiors of wash drums 11, 13, and 15, respectively. Syphon tubes 43 and 44 should be understood to be the same in construction and operation as the syphon tube 39 which is described above. Also provided but not shown are conventional primer means to provide initial suction in the respective syphon tubes.

Referring still to FIG. 1, open tanks 45, 47, and 49 are mounted below the respective wash drums 11, 13, and 15. The tanks are constructed and positioned to encompass the lower half or less of each of the respective wash drums and to contain a substantial quantity of liquid exterior of the wash drums. In practice, the tanks preferably will be identical to one another and will be mounted in vertically-stepped relationship corresponding to the differential elevations of the wash drums.

A liquid inlet means, such as a conduit 51 shown in FIG. 1, is connected in communication with the tank 49 to carry wash liquor thereinto. In some applications, the wash liquor may simply be fresh water while in other instances it may be aqueous solution of particular chemicals. As will be understood in view of the following description, the flow of wash liquid is countercurrent to the direction of travel of pulp material through the machine.

Figure 3:
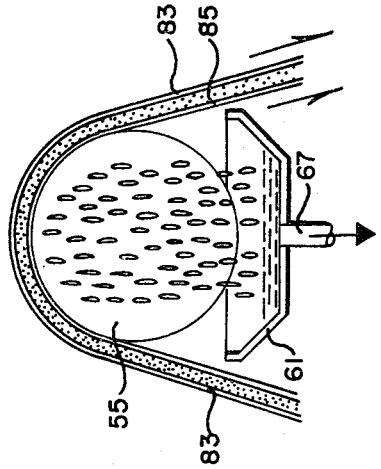
FIG. 3 shows a detail of the machine of FIG. 1 enlarged for purposes of clarity.

Referring now to FIGS. 1 and 3, a so-called compression roller member 55 is mounted to the right and above the first wash drum and is supported for rotation by conventional means, not shown. Likewise, a second compression roller member 57 is rotatably mounted to the right and above the second wash drum 13, and a third compression roller member 59 is rotatably mounted to the right and above the last wash drum 15. The compression roller members are essentially the same in construction and operation although, in practice, they need not be all of the same diameter. The compression roller member 55 shown in FIG. 3 comprises, for example, a rigid hollow cylinder which is formed from wire screen or other foraminous material so that liquid can drain freely through it.

Below the respective compression roller members 55, 57, and 59 are mounted troughs 61, 63, and 65 to catch the liquid which drains through the roller members. In the art, this liquid is known as mother or concentrated liquor. A first conduit 67 is connected in liquid flow communication with the first trough 61 to carry this concentrated liquor to discharge remote from the machine. Likewise, a second conduit 69 is connected in flow communication with the second trough 63; this conduit 69 carries the concentrated liquor from trough 63 to discharge into the first tank 45. A third conduit 71 is connected to the third trough 65 to carry concentrated liquor from that trough to the second tank 47.

As further shown in FIG. 1, the syphon tube 39 associated with the first wash drum 11 is connected to carry the liquid drawn from the interior of the first wash drum 11 to discharge. The syphon tube 43 associated with the second wash drum 13 is connected to the second conduit 69 so that liquid drawn from the interior of the second wash drum 13 is conveyed to the first tank 45. Finally, the syphon tube 44 associated with the third wash drum 15 is connected to the third conduit 71 so that liquid drawn from the interior of the third wash drum 13 is conveyed to the second tank.

The machine in FIG. 1 further includes feed means which, in the illustrated embodiment by way of example, comprises a horizontal vacuum pan 75 of conventional construction which is mounted to the left of the first wash drum 11. A conventional suction-producing device, not shown, is connected in communication with the interior of the vacuum pan to draw liquid therefrom via a conduit 76. Above the vacuum pan 75 is mounted a distribution box 77, which also can be understood to be of conventional construction. At the opposite ends of the vacuum pan are rotatably mounted support rollers 79 and 81, respectively. One skilled in this art should readily recognize that the feed means could, alternatively, comprise other conventional means for forming a pulp mat between two belts. For example, the mat could be formed on a conventional vacuum drum means or it could be formed between two belts disposed substantially vertically.

Two endless belts 83 and 85, referred to herein as the upper and lower belts respectively, are trained around the wash drums and the compression roller members in zig-zag fashion as illustrated in FIG. 1. More particularly, the endless belts are trained in face-to-face relationship to each other to pass under each of the wash drums 11, 13, and 15 and over each of the compression roller members 55, 57, and 59. The endless belts should be understood to comprise conventional porous belts of the type which are well known in the filtration art.

Above the machine, the upper belt 83 is trained over a set of guide rollers 90–94; below the machine, the lower belt 85 is trained over a set of guide rollers 96–100. Conventional drive means, not shown, are connected to rotatably drive at least one of the wash drums and, thus, to cause the two endless belts 83 and 85 to travel together at equal speeds in the directions indicated by the arrows in FIG. 1. The upper and lower sets of guide rollers are positioned to separate the upper and lower belts after the belts have passed over the third compression roller member 59 and, at the opposite end of the machine, to reunite the belts in face-to-face relationship before the belts travel under the first wash drum 11. It should be further observed that the lower set of guide rollers 96–100 is positioned so that the lower belt 85 passes around the support roller 79; then the lower belt 85 is trained between the vacuum pan 75 and the distribution box 77 and, finally over the support roller 81 before reuniting with the upper belt 83. In practice, at least one guide roller in both the upper and lower sets is movably mounted so that the tensions of the belts can be selectively adjusted. Also, conventional means for laterally aligning the belts are normally provided.

The operation of the above-described machine can now be understood. Initially a free-filtering material, such as paper stock containing digestion chemicals, is fed into the distribution box 77 as indicated by the arrow. That material is then discharged onto the belt 85 as it travels across the vacuum pan 75. Suction applied through the vacuum pan 75 draws liquid from the pulp, leaving a sheet or mat of partially dewatered fibers lying on the belt 85. The withdrawn liquid, or filtrate, is discharged from the machine via conduit 76. The lower belt 85, after passage across the vacuum pan, meets the upper belt 83 in face-to-face relationship and, thus, the mat of pulp fibers is gripped between the two belts. Typically, the pulp mat is about one-quarter to one inch in thickness.

The two belts 83 and 85, with the pulp mat between them, then pass into the first tank 45 and under the first wash drum 11. Simultaneously the wash drum 11 is rotated, say by frictional engagement with the upper belt 83. At this time, liquid from the first wash tank 45 passes through the pulp mat between the two belts and then flows into the interior of the first wash drum 11. This flow of liquid through the pulp mat occurs because of the differential in the hydrostatic head (liquid level) between the interior and exterior of the wash drum 11; the differential head is provided and sustained by the syphon tube 39 which continuously draws liquid from the interior of the wash drum 11. The flow of liquid through the pulp mat serves to wash the pulp and, in some instances, also increases the moisture content of the pulp mat because some of the wash liquid is absorbed by the pulp.

The two belts 83 and 85, after passing under the wash drum 11, then pass over the first compression roller member 55. During this stage, the pulp mat is squeezed between the belts due to the tension in the upper belt 83. Liquid, which is thus expressed from the pulp, drains through the roller member 55 as shown in FIG. 3. The expressed liquor is caught by the trough 61 and is carried to disposal via the conduit 67.

After passage over the first compression roller member 55, the two endless belts 83 and 85 carry the pulp mat into the second tank 47 and then under the second wash drum 13. During this stage, the pulp mat undergoes a second wash like the one described above. Then, the two belts 83 and 85 with the pulp mat therebetween pass over the second compression roller member 57, then under the third wash drum 15, and finally over the third compression roller member 59. Thus it can be seen that the pulp mat undergoes three stages of washing and expression. Next, the upper and lower belts 83 and 85 are moved apart by the guide rollers 94 and 96 to expose the washed pulp mat. The pulp mat is then discharged from the machine by suitable means, not shown, such as a doctor blade or the like.

As mentioned earlier, the upper and lower belts are held under predetermined tensions by the adjustable guide rollers. The tensions need not be the same. In fact, the upper belt 83 is preferably at greater tension than the lower belt 85. This causes the compressive force on the pulp mat to be greater when the mat passes over the compression rollers 55, 57, and 59 than when it passes under the wash drums 11, 13, and 15. This is advantageous because the pulp mat is "worked", i.e., compressed during its passage over the compression roller members and allowed to expand and absorb wash liquid when passing under the wash drums. This working can be likened to wringing a sponge and then allowing it to expand to absorb more water.

At this juncture, it should be understood that the flow of wash liquor through the illustrated machine is opposite to the travel of the pulp mat. More specifically, fresh wash liquor is continuously fed into the third tank 49 via inlet conduit 51 at sufficient flow rates to keep approximately the lower half of the wash drum 15 submerged. Suitable control means, not shown, are preferably provided to insure that this liquor level is maintained. This fresh wash liquor, as previously described, is then forced into the wash drum 15 through the submerged pulp mat due to the hydrostatic head difference between the interior and exterior of the drum 15. Then, the once-used wash liquor is drawn from the interior of the wash drum 15 by the syphon tube 44 and is conveyed into the second tank 44 via the conduit 71. The liquid in the second tank 47 then is forced into the interior of the second wash drum 13 by the hydrostatic head in the second wash tank 47 and, followingly, is drawn from the wash drum 13 by the second syphon tube 43 and conveyed into the first tank 11 via the conduit 69. Concurrent with the flow of wash liquid through the machine, there is the previously described flow of concentrated liquor which is expressed from the pulp mat as it traverses the compression roller members 55, 57, and 59.

It should now be apparent that a machine according to this invention can include just two pairs of wash drums and tanks, rather than the three pairs described above. Alternatively, the machine can include more than three pairs of wash tanks and drums depending upon the number of stages of washing which are required for a particular application.

I claim:

1. A machine for washing paper stock pulp and similar free filtering materials comprising:

(a) two or more horizontally-disposed wash drums each having a sidewall through which liquid can pass and end closure walls, said wash drums being mounted for rotation about their horizontal axes and disposed in side-by-side, vertically-stepped relationship with the first of said drums being the lowest and the last being the highest;

(b) two or more open tanks mounted to encompass the lower half or less of respective ones of said wash drums, said tanks being constructed to contain liquid exterior to said wash drums;

(c) roller members mounted for rotation at spaced-apart locations above each of said wash drums;

(d) first and second endless filter belts trained to pass under each of said wash drums and over each of said roller members in face-to-face relationship with each other to hold a mat of material to be washed;

(e) a first set of guide means mounted above said wash drums to guide said first endless filter belt from the last of said wash drums to the first of said wash drums, and a second set of guide means mounted below said wash drums to guide said second endless filter belt from the last of said wash drums to the first of said wash drums;

(f) drive means mounted to drive said first and second endless belts;

(g) liquid inlet means to introduce liquid into said wash tank associated with the highest of said wash drums; and (h) syphon means connected in communication with each of said wash drums to draw liquid from the interiors of said drums to provide a hydrostatic head differential between the interiors of said wash drums and the liquid contents of the associated said tanks thereby to force liquid through the material held between said first and second endless belts.

2. A machine according to claim 1 wherein said syphon means comprises a barometric leg.

3. A machine according to claim 1 wherein the one of said syphon means which is connected to said highest wash drum is disposed to convey withdrawn liquid into one of said tanks.

4. A machine according to claim 3 wherein said one of said syphon means is connected to discharge withdrawn liquid into the tank which is associated with the next lower one of said wash drums.

5. A machine according to claim 1 further including trough means mounted below said roller members to catch liquid drainage when said first and second endless drainage belts pass over said roller members.

6. A machine according to claim 5 wherein said roller members each comprise a rigid, hollow cylinder formed from foraminous material which lets liquid drain freely through it.

7. A machine according to claim 5 wherein conduit means are connected to said trough means to carry liquid to said wash tanks.

8. A machine according to claim 1 further including means to adjustably position at least one of the guide means of said first set to thereby adjust the tension in said first endless belt.

9. A machine according to claim 1 further including (a) vacuum pan means mounted adjacent the lowermost one of said wash drums and (b) means mounted adjacent the ends of said vacuum pan means to guide said second endless drainage belt to pass over said vacuum pan means.

10. A machine according to claim 1 wherein said first belt is at greater tension than said second belt so that a greater compressive force is exerted upon the material held between the two belts when the same pass over said roller members than when said belts pass under said wash drums.

11. In a machine including two or more wash drums mounted in associated open tanks which contain liquid exterior of the wash drums, which drums have perforated sidewalls and are arranged in vertically-stepped relationship to one another, the first drum being the lowest and the last drum being the highest, a method of washing paper stock pulp and like free-filtering materials comprising:

a. training a pair of endless filter belts in face-to-face relationship to pass under each of said filter drums;

b. forming a mat of the material between the two belts;

c. driving the two belts to carry the mat of material under each of the drums from the first to the last;

d. introducing liquid into the interior of the tank associated with the last said drum to flow through the mat of material and then through the perforated sidewall of that drum and then into the drum, whereby the pulp mat is washed by the liquid;

e. conveying without pumping, the once-used liquid from the interior of the last drum to the tank associated with a lower drum;

f. removing the washed mat of pulp from between the two belts after the belts have passed under the last drum; and, g. removing the liquid from the first drum.

* * * * *